US010366827B2

(12) United States Patent
Akimoto

(10) Patent No.: US 10,366,827 B2
(45) Date of Patent: Jul. 30, 2019

(54) IGNITION COIL FOR INTERNAL COMBUSTION ENGINE

(71) Applicant: DENSO CORPORATION, Kariya, Aichi-pref. (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 102 days.

(21) Appl. No.: 15/784,394

(22) Filed: Oct. 16, 2017

(65) Prior Publication Data

US 2018/0108473 A1 Apr. 19, 2018

(30) Foreign Application Priority Data

Oct. 17, 2016 (JP) ..... 2016-203604

(51) Int. Cl.

| | |
|---|---|
| ***F02P 3/02*** | (2006.01) |
| ***H01F 27/28*** | (2006.01) |
| ***H01F 38/12*** | (2006.01) |
| ***H01T 13/04*** | (2006.01) |
| *F02P 13/00* | (2006.01) |
| *F02P 3/04* | (2006.01) |

(52) U.S. Cl.

CPC ..... *H01F 38/12* (2013.01); *F02P 3/02* (2013.01); *H01F 27/28* (2013.01); *H01T 13/04* (2013.01); *F02P 3/04* (2013.01); *F02P 13/00* (2013.01)

(58) Field of Classification Search

CPC ..... H01F 38/12; H01F 27/28; H01F 27/02; H01F 27/29; H01F 2038/122; H01R 13/20; H01T 13/04; H01T 13/06; F02P 3/02

See application file for complete search history.

(56) References Cited

U.S. PATENT DOCUMENTS

| | | | | |
|---|---|---|---|---|
| 4,997,380 | A * | 3/1991 | Etienne | H01T 13/04 439/127 |
| 5,382,170 | A * | 1/1995 | Imanishi | F02P 3/02 123/169 PH |
| 5,547,387 | A * | 8/1996 | Kobayashi | F02P 3/02 439/125 |
| 5,971,776 | A * | 10/1999 | Neel | H01R 13/53 439/125 |
| 2008/0271724 | A1 | 11/2008 | Idogawa et al. | |
| 2009/0033451 | A1 * | 2/2009 | Akimoto | H01F 5/04 336/96 |

FOREIGN PATENT DOCUMENTS

| | | |
|---|---|---|
| JP | 2012-193737 | 10/2012 |
| JP | 2013-029057 | 2/2013 |

* cited by examiner

*Primary Examiner* — George C Jin

(74) *Attorney, Agent, or Firm* — Nixon & Vanderhye P.C.

(57) ABSTRACT

An ignition coil for an internal combustion engine includes a coil main body portion, a connecting portion, and a conducting member. A convex surface forming portion, which is a portion constituting an inner peripheral convex surface, is disposed in the connecting portion. The convex surface forming portion has an outer peripheral concave surface. The connecting portion has a boundary portion which is a boundary between the convex surface forming portion and other portions in the axial direction. In the convex surface forming portion, at least a part of a region where the outer peripheral concave surface is formed has a portion having an area, in a cross-section orthogonal to the axial direction, equal to or smaller than that of the boundary portion. A thickness of the convex surface forming portion is equal to or thicker than that of the boundary portion.

9 Claims, 12 Drawing Sheets

IGNITION COIL FOR INTERNAL COMBUSTION ENGINE

CROSS-REFERENCE TO RELATED APPLICATION

This application is based on and claims the benefit of priority from earlier Japanese Patent Application No. 2016-203604 filed Oct. 17, 2016, the description of which is incorporated herein by reference.

TECHNICAL FIELD

The present disclosure relates to an ignition coil for an internal combustion engine.

BACKGROUND

For example, Patent Document 1 (Japanese Patent No. 4267042, for example) discloses an ignition coil for an internal combustion engine, which includes a main body that has a primary coil and a secondary coil magnetically coupled to each other, and a plug boot for connecting the main body and a spark plug.

The plug boot has a tubular shape, and is flexible and electrically insulating. A coil spring for electrically connecting the secondary coil and the spark plug is inserted and disposed inside the plug boot.

The plug boot has a role of electrically insulating the coil spring inserted inside the plug boot and the outside of the plug boot.

Here, the ignition coil may be used by inserting a plug boot into a bent plug hole.

In view of this, the ignition coil disclosed in Patent Document 1 has a thin-walled portion formed in a part of the plug boot in an axial direction. The thin-walled portion is formed thinner than the other portions by recessing an outer peripheral surface of the plug boot toward an inner peripheral side thereof.

Accordingly, the ignition coil disclosed in Patent Document 1 aims to allow easy bending of the plug boot in the thin-walled portion and easy insertion into the bent plug hole.

However, the withstand voltage of the plug boot is determined according to the thickness of the plug boot. That is, the lower the thickness of the plug boot, the lower the withstand voltage.

Therefore, in the ignition coil disclosed in Patent Document 1, it is required to have a thickness at least to the thin-walled portion greater than or equal to the thickness that can ensure electrical insulation between the inside and the outside thereof.

Furthermore, a portion that is stretched by bending occurs in the thin-walled portion when the plug boot is bent at the thin-walled portion.

This portion becomes smaller in thickness than when it is in a free state where the plug boot is not bent.

Therefore, in the ignition coil bent at the thin portion, considering that the thickness of the thin portion becomes thinner after the plug boot is bent at the thin portion, a sufficient thickness may not be obtained at the thin portion for obtaining insulation.

Along with this, portions other than the thin wall portion of the plug boot necessarily have a wall thickness sufficiently thicker than the thickness required for securing electrical insulation between the inside and the outside thereof. This leads to an increase in the cost and size of the plug boot.

SUMMARY

An embodiment provides an ignition coil for an internal combustion engine capable of achieving cost reduction and downsizing while obtaining insulation.

In an ignition coil for an internal combustion engine according to a first aspect, the ignition coil includes a coil main body portion having a primary coil and a secondary coil magnetically coupled to each other, a cylindrical connecting portion for connecting the coil main body portion and a spark plug, and a conducting member disposed inside the connecting portion and electrically connecting the coil main body portion and the spark plug.

A convex surface forming portion, which is a portion constituting an inner peripheral convex surface of which an inner peripheral surface projects toward an inner peripheral side, is disposed in the connecting portion, the convex surface forming portion has an outer peripheral concave surface of which an outer peripheral surface is recessed toward the inner peripheral side, and the connecting portion has a boundary portion which is a boundary between the convex surface forming portion and other portions in an axial direction.

In the convex surface forming portion, at least a part of a region where the outer peripheral concave surface is formed has a portion having an area, in a cross-section orthogonal to the axial direction, equal to or smaller than an area of a cross-section orthogonal to the axial direction in the boundary portion, and a thickness of the convex surface forming portion is equal to or thicker than a thickness of the boundary portion.

In the ignition coil for the internal combustion engine, the convex surface forming portion has an outer peripheral concave surface of which outer peripheral surface is recessed toward the inner peripheral side.

Therefore, the connecting portion is able to obtain sufficient flexibility in the outer peripheral concave surface of the convex surface forming portion of which the outer diameter is reduced.

Further, in the convex surface forming portion, at least a part of a region where the outer peripheral concave surface is formed has a portion having an area, in a cross-section orthogonal to the axial direction, equal to or smaller than an area of a cross-section orthogonal to the axial direction in the boundary portion.

This also obtains sufficient flexibility in the outer peripheral concave surface of the convex surface forming portion in the connecting portion.

Here, since the convex surface forming portion is easily bent as described above, a high withstand voltage is required in consideration of thinning due to bending as compared with other portions.

Therefore, the thickness of the convex surface forming portion is set to be equal to or thicker than the thickness of the boundary portion in the ignition coil.

Therefore, it is possible to obtain the withstand voltage of all of the connecting portion by setting the thickness of the convex surface forming portion to such a thickness that the withstand voltage can be obtained.

Further, it is possible to suppress the thickness of a portion other than the convex surface forming portion in the connecting portion from increasing which does not require a higher withstand voltage than the convex surface forming portion.

Thereby, it is possible to reduce the material cost of the connecting portion and to downsize the connecting portion.

As described above, according to the above aspect, it is possible to provide an ignition coil for an internal combustion engine capable of reducing cost and downsizing while ensuring insulation.

DETAILED DESCRIPTION OF THE PREFERRED EMBODIMENT

[First Embodiment]

An embodiment of an ignition coil for an internal combustion engine will be described with reference to FIGS. 1 to 6.

Figure 1:
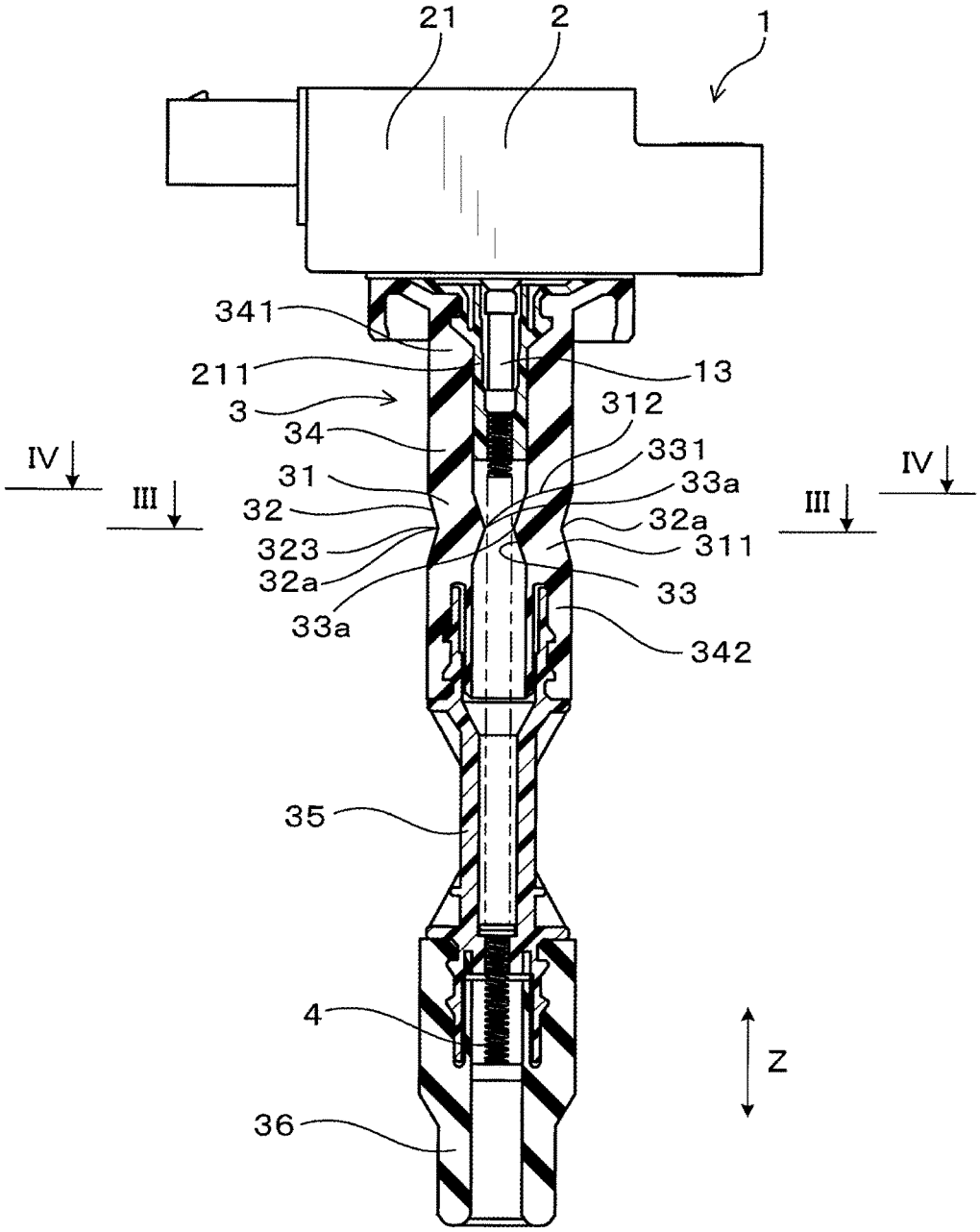
FIG. 1 shows a partial axial-sectional view of an ignition coil for an internal combustion engine in a first embodiment.

As shown in FIG. 1, an ignition coil 1 for an internal combustion engine of the present embodiment has a coil main body portion 2, a connecting portion 3, and a conducting member 4.

The coil main body portion 2 has a primary coil and a secondary coil (neither shown) magnetically coupled to each other.

Figure 6:
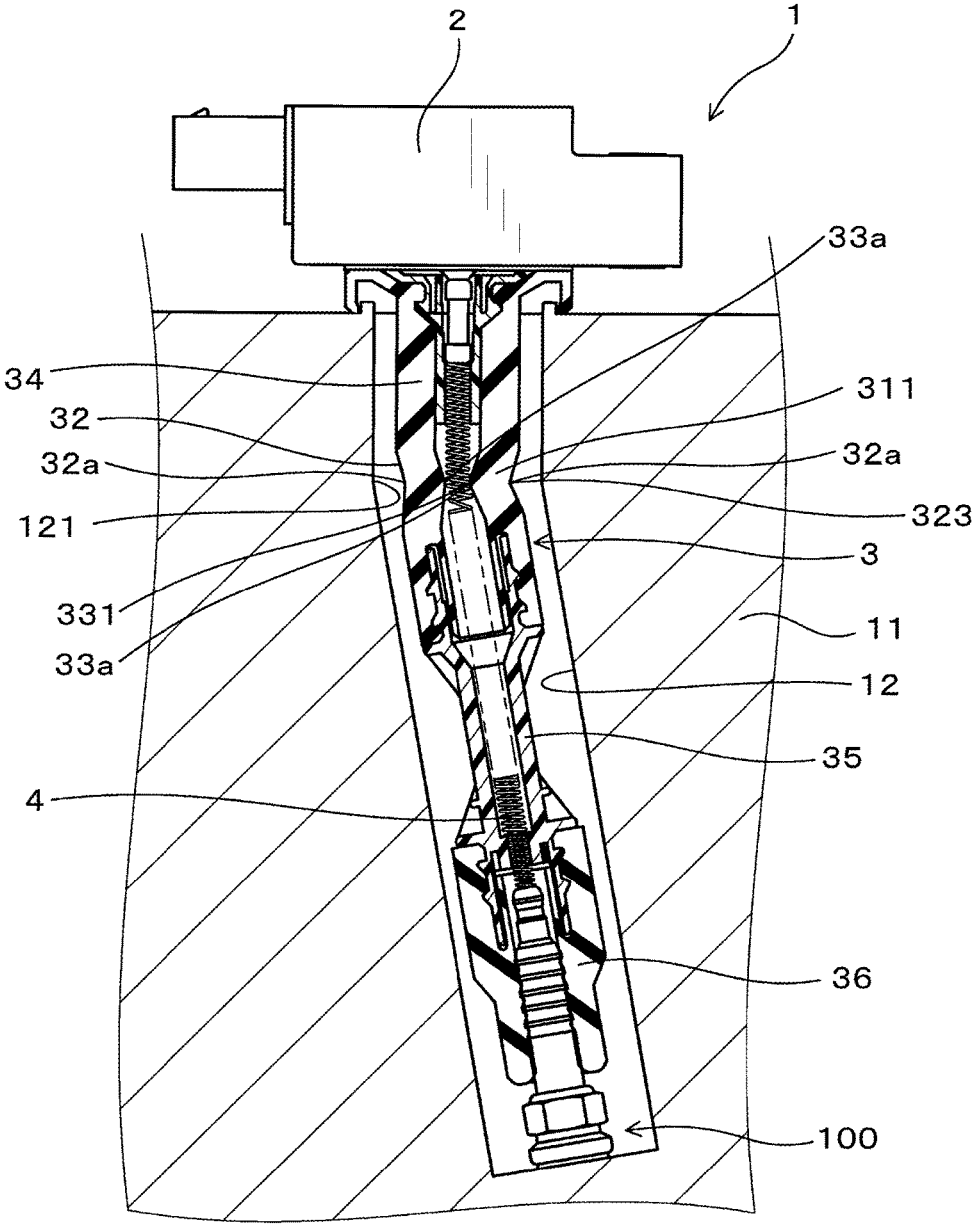
FIG. 6 shows a view of a mounting structure in which the ignition coil is attached to the internal combustion engine in the first embodiment.

As shown in FIG. 6, the connecting portion 3 connects the coil main body portion 2 and a spark plug 100.

The connecting portion 3 has a tubular shape as shown in FIGS. 1 to 4.

The conducting member 4 is disposed inside the connecting portion 3 as shown in FIG. 1.

The conducting member 4 electrically connects the secondary coil and the spark plug 100 as shown in FIG. 6.

Figure 2:
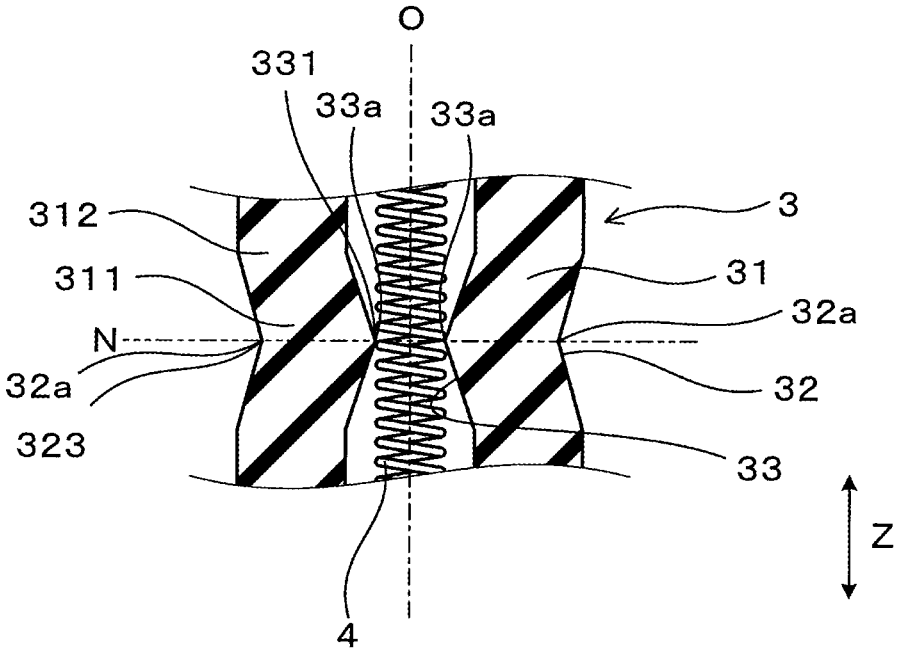
FIG. 2 shows an enlarged view in a periphery of a convex surface forming portion of FIG. 1.

As shown in FIGS. 1 and 2, the connecting portion 3 is provided with a convex surface forming portion 311 which is a portion constituting an inner peripheral convex surface 33, the inner peripheral surface of which protrudes toward an inner peripheral side.

The convex surface forming portion 311 has an outer peripheral concave surface 32, the outer peripheral surface of which is recessed toward the inner peripheral side.

The connecting portion 3 has a boundary portion 312 which is a boundary between the convex surface forming portion 311 and other portions in an axial direction Z thereof.

Figure 5:
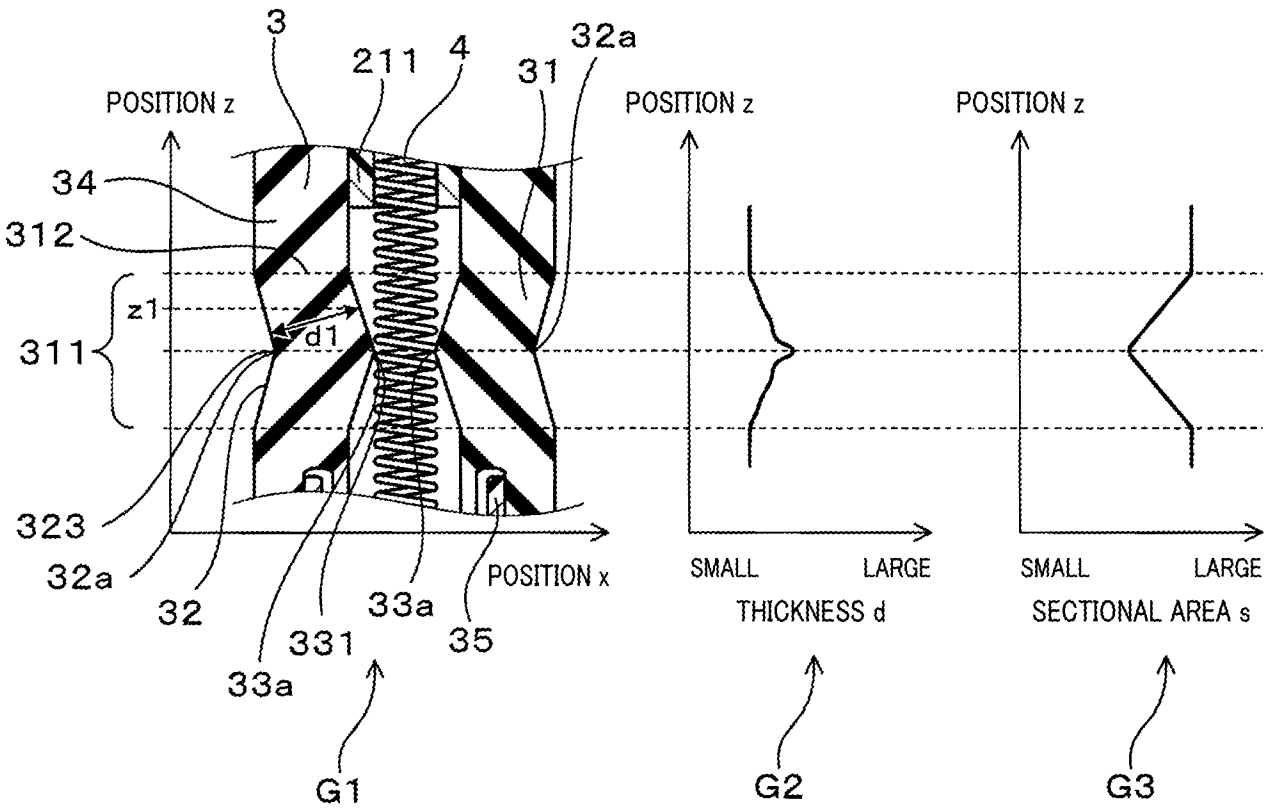
FIG. 5 shows graphs for explaining thickness and the cross-sectional area of a bendable portion in the first embodiment.

As shown in FIG. 5 to be described later, in the convex surface forming portion 311, at least a part of a region where the outer peripheral concave surface 32 is formed has a portion having an area, in a cross-section orthogonal to the axial direction Z, equal to or smaller than that of the boundary portion 312.

The thickness of the convex surface forming portion 311 is equal to or thicker than the thickness of the boundary portion 312.

Note that hereinafter, when simply referring to a cross-sectional area, it means an area of a cross-section orthogonal to the axial direction Z unless otherwise specified.

Figure 3:
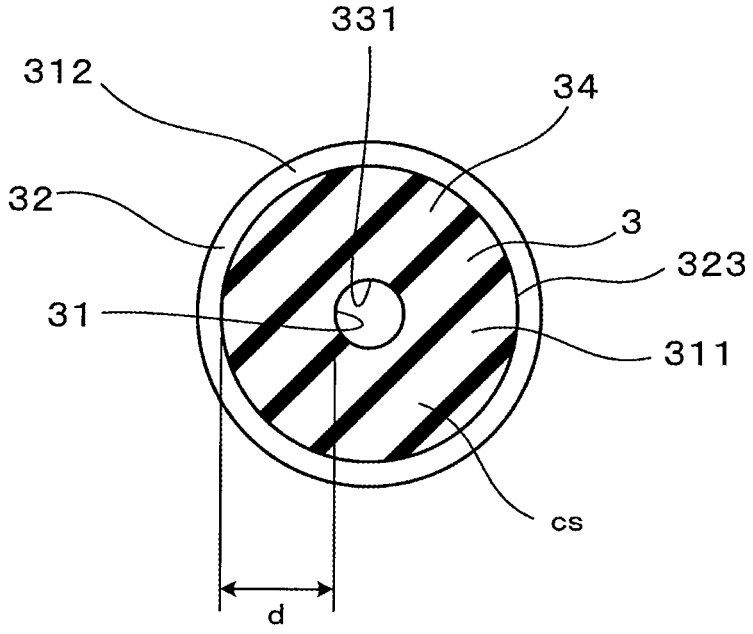
FIG. 3 shows a cross-sectional view taken along a line III-III of FIG. 1.

In addition, a cross-sectional area of the convex surface forming portion 311 is, for example, an area of the cross-section cs hatched in FIG. 3.

Figure 4:
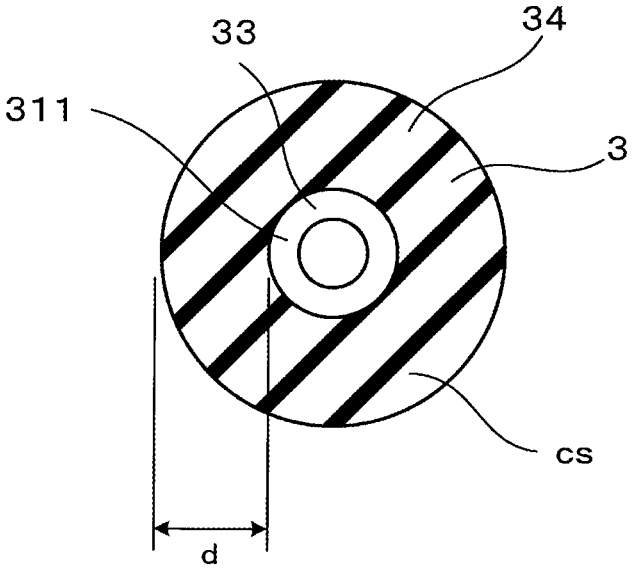
FIG. 4 shows a cross-sectional view taken along a line IV-IV of FIG. 1.

Similarly, a cross-sectional area of the boundary portion 312 is, for example, an area of the cross-section cs hatched in FIG. 4.

In other words, the cross-sectional area of the convex surface forming portion 311 or the cross-sectional area of the boundary portion 312 is a cross-sectional area of an annular region that does not include a hollow portion of the connecting portion 3.

The ignition coil 1 of the present embodiment is connected to the spark plug 100 installed in an internal combustion engine of an automobile, cogeneration apparatus, etc., and is used as a means for applying a high voltage to the spark plug 100 as shown in FIG. 6.

The ignition coil 1 is used by inserting the connecting portion 3 into a plug hole 12 of an engine head 11.

It is assumed in the present embodiment that although the plug hole 12 into which the connecting portion 3 of the ignition coil 1 is inserted has a bent portion 121 bent at a substantially center portion in the axial direction Z, it is not limited thereto.

The coil body 2 is constituted of the primary coil and the secondary coil accommodated in a case 21 having electrical insulation as shown in FIG. 1. The case 21 is made of resin in the present embodiment.

It should be noted that a core or the like constituting a magnetic path of a magnetic field generated by energizing the primary coil is also accommodated in the case 21.

The case 21 has a cylindrical high-voltage tower portion 211 protruding in one direction in the axial direction Z.

Hereafter, a protruding side of the high-voltage tower portion 211 of the case 21 in the axial direction Z may be referred to as a tip end side and an opposite side may be referred to as a base end side.

A resistor 13 is inserted and disposed in the high-voltage tower portion 211. The resistor 13 suppresses noise current from being transmitted from the spark plug 100 connected to the ignition coil 1 to the secondary coil.

The high-voltage tower portion 211 is fitted with the connecting portion 3 from the tip end side of the high-voltage tower portion 211.

The connecting portion 3 includes a seal having elasticity, specifically a sealing rubber 34, a pole joint 35, and a plug cap 36 in the present embodiment.

As shown in FIG. 6, the sealing rubber 34 seals between the coil body 2 and the engine head 11 through which the ignition coil 1 is inserted.

The pole joint 35 is fitted to an end of the sealing rubber 34 on which the spark plug 100 is disposed. The pole joint 35 is made of resin.

The pole joint 35 is made of, for example, PPS (that is, polyphenylene sulfide resin), PBT (that is, polybutylene terephthalate resin), unsaturated polyester, or the like.

The plug cap 36 fits with the spark plug 100. A base end portion of the plug cap 36 is fitted to a tip end portion of the pole joint 35. Although the sealing rubber 34 and the plug cap 36 are made of silicone rubber, the material is not limited thereto.

As shown in FIG. 1, the convex surface forming portion 311 is formed in the sealing rubber 34.

The sealing rubber 34 has a rubber base end portion 341 at the base end portion thereof fitted to the high-voltage tower portion 211.

In addition, the sealing rubber 34 has a rubber tip end portion 342 fitted to a base end portion of the pole joint 35 at a tip end portion thereof.

Further, between the rubber base end portion 341 and the rubber tip end portion 342 of the sealing rubber 34 in the axial direction Z is a bendable portion 31 which will be described hereafter.

The bendable portion 31 is an elastically bendable portion of the connecting portion 3.

Here, being elastically bendable means that it can be bent when an external force is applied, and can return to substantially an original state when the external force is released.

The pole joint 35 of the connecting portion 3 is made of a resin and thus is not elastically bendable, for example.

In addition, since the rubber base end portion 341 and the rubber tip end portion 342 of the connecting portion 3 are fitted with rigid portions such as the resin-made high-voltage tower portion 211 and the pole joint 35, they cannot be bent even if an external force is applied thereto.

Therefore, the rubber base end portion 341 and the rubber tip end portion 342 are portions not elastically bendable.

At least a region from the tip end of the high-voltage tower portion 211 to the base end of the pole joint 35 of the sealing rubber 34 in the axial direction Z is the bendable portion 31 in the present embodiment.

The bendable portion 31 of the connecting portion 3 has the convex surface forming portion 311 in a part in the axial direction Z.

As shown in FIG. 6, the convex surface forming portion 311 is formed so as to be disposed at a position facing the bent portion 121 of the plug hole 12 in a state where the ignition coil 1 is inserted into the plug hole 12 of the engine head 11.

As shown in FIG. 2, the inner peripheral convex surface 33 is formed such that a part of an inner peripheral surface of the connecting portion 3 in the axial direction Z is reduced in diameter.

That is, the inner peripheral convex surface 33 is formed over the entire periphery of the connecting portion 3.

In the connecting portion 3, a region from one end to another end of the inner peripheral convex surface 33 in the axial direction Z is the convex surface forming portion 311.

In addition, as described above, the convex surface forming portion 311 includes the outer peripheral concave surface 32.

The outer peripheral concave surface 32 is formed such that a part of an outer peripheral surface of the connecting portion 3 in the axial direction Z is reduced in diameter.

That is, the outer peripheral concave surface 32 is formed over the entire circumference of the connecting portion 3.

The outer peripheral concave surface 32 is formed in at least a part of a region where the inner peripheral convex surface 33 is formed in the axial direction Z.

The outer peripheral concave surface 32 is formed in the entire region of the region where the inner peripheral convex surface 33 is formed in the axial direction Z in the present embodiment.

In a cross-section parallel to the axial direction Z passing through a center axis O of the connecting portion 3, the inner peripheral convex surface 33 tapers inward toward the center in the axial direction Z, and has a substantially V shape.

Similarly, in the cross-section parallel to the axial direction Z passing through the central axis of the connecting portion 3, the outer peripheral concave surface 32 has a shape which is inclined so as to approach toward the inner peripheral side as it approaches toward the center in the axial direction Z, and has a substantially V shape.

When a portion having the smallest inner diameter in the inner peripheral convex surface 33 is defined as a minimum inner diameter portion 331 and a portion having the smallest outer diameter in the outer peripheral concave surface 32 is defined as a minimum outer diameter portion 323, the minimum inner diameter portion 331 and the minimum outer diameter portion 323 are disposed at the same position in the axial direction Z.

In the present embodiment, the minimum inner diameter portion 331 of the inner peripheral convex surface 33 appears as a pair of first point portions 33*a* having substantially no length (i.e., a narrow portion) at a cross-section parallel to the axial direction Z passing through the center axis O of the connecting portion 3 (hereinafter referred to as a center axial-section) as shown in FIG. 2.

Further, the minimum outer diameter portion 323 of the outer peripheral concave surface 32 appears as a pair of second point portions 32*a* having substantially no length (i.e., a narrow portion) at the center axial-section as shown in FIG. 2 in the present embodiment.

Furthermore, in the center axial-section, a virtual straight line N connecting the pair of first point portions 33*a* and the pair of second point portions 32*a* is orthogonal to the center axis O of the connecting portion 3.

It should be noted that a virtual straight line connecting the pair of first point portions 33*a* and the pair of second point portions 32*a* in the center axial-section may be inclined with respect to a straight line orthogonal to the central axis O of the connecting portion 3.

FIG. 5 shows first to third graphs G1, G2, and G3 arranged side by side which will be described hereafter.

The first graph G1 shows an axial-sectional view parallel to the axial direction Z passing through the central axis of the connecting portion 3 in a periphery of the convex surface forming portion 311 in the ignition coil 1.

In the first graph G1, a vertical axis shows a position z in the axial direction Z, and a horizontal axis shows a position x in the direction X orthogonal to the axial direction Z in the cross-section of the first graph G1.

The second graph G2 shows a relationship between the position z of the inner peripheral surface of the bendable portion 31 in the axial direction Z and a thickness d of the bendable portion 31 at the position z.

Here, the thickness d at an arbitrary position z of the bendable portion 31 is the shortest distance from a portion at the arbitrary position z on the inner peripheral surface of the bendable portion 31 to an outer peripheral surface of the bendable portion 31.

For example, as shown in FIGS. 3 and 5, when a position z is at a position of the minimum inner diameter portion 331 of the inner peripheral convex surface 33, a value of the thickness d is the thickness of the convex surface forming portion 311 in a radial direction.

Further, as shown in FIGS. 4 and 5, when a position z is at a position of the boundary portion 312, a value of the thickness d is the thickness of the boundary portion 312 in the radial direction.

Further, as shown in FIG. 5, when a position z is at a position z1 between the minimum inner diameter portion 331 and the boundary portion 312, a value dl of the thickness d is the thickness of the bendable portion 31 in a direction inclined in the radial direction.

The third graph G3 shows a relationship between a position z of the bendable portion 31 in the axial direction Z and an area s of a cross-section orthogonal to the axial direction Z of the bendable portion 31 (a cross-section indicated by reference character cs in FIG. 3, FIG. 4, etc. for example).

In each of the three graphs shown in FIG. 5, the vertical axis indicating the position z in the axial direction Z is matched.

Further, in the second graph G2, the thickness d on the horizontal axis becomes larger toward the right side of the drawing, and becomes smaller toward the left side of the drawing.

Furthermore, in the third graph G3, a cross-sectional area s on the horizontal axis becomes larger toward the right side of the drawing, and becomes smaller toward the left side of the drawing.

Then, a comparison of the thickness d and a comparison of the cross-sectional area s are performed between the boundary portion 312 and the convex surface forming portion 311 from the second graph G2 and the third graph G3.

It should be noted that, as described above, the boundary portion 312 is a boundary in the axial direction Z between the convex surface forming portion 311 and the other parts of the connecting portion 3.

That is, a portion where both end portions of the inner peripheral convex surface 33 in the axial direction Z are located is the boundary portion 312 in the connecting portion 3.

As can be seen from the second graph G2 in FIG. 5, the thickness of the convex surface forming portion 311 is thicker than or equal to the thickness of the boundary portion 312 in the entire axial direction Z.

In addition, the thicknesses of the convex surface forming portions 311 are thicker than or equal to the thickness of the portion of the bendable portion 31 other than the convex surface forming portion 311 in the entire axial direction Z.

The thickness of the convex surface forming portion 311 becomes thicker toward the center from both ends of the convex surface forming portion 311 in the axial direction Z.

Then, in the convex surface forming portion 311, a portion where the minimum inner diameter portion 331 of the inner peripheral convex surface 33 and the minimum outer diameter portion 323 of the outer peripheral concave surface in the axial direction Z are formed has the largest thickness.

Further, as can be seen from the third graph G3 in FIG. 5, the cross-sectional areas of the convex surface forming portion 311 are equal to or less than the cross-sectional area of the boundary portion 312 in the entire axial direction Z.

Furthermore, the cross-sectional areas of the convex surface forming portion 311 are equal to or less than the cross-sectional area of portions other than the convex surface forming portion 311 in the bendable portion 31 in the entire axial direction Z.

The cross-sectional area of the convex surface forming portion 311 decreases as it approaches from both ends to the center in the axial direction Z.

Then, in the convex surface forming portion 311, a portion where the minimum inner diameter portion 331 of the inner peripheral convex surface 33 and the minimum outer diameter portion 323 of the outer peripheral concave surface 32 in the axial direction Z are formed has the smallest cross-sectional area.

As shown in FIG. 1, the conducting member 4 is disposed inside the connecting portion 3.

The conducting member 4 is formed by spirally winding a conducting wire and is constituted elastically deformable in the axial direction Z in the present embodiment.

The conducting member 4 has a constant outer diameter in the axial direction Z.

As shown in FIG. 2, the conducting member 4 is fitted in the inner peripheral convex surface 33 of the convex surface forming portion 311 of the connecting portion 3. Thereby, the conducting member 4 is positioned in the axial direction Z with respect to the connecting portion 3.

As shown in FIG. 1, the conducting member 4 elastically presses the resistor 13 disposed in the high-voltage tower portion 211 toward the base end side at a base end portion thereof. Thereby, the conducting member 4 is electrically connected to the secondary coil via the resistor 13 or the like.

Further, as shown in FIG. 6, as the spark plug 100 is fitted into the plug cap 36, a tip end portion of the conducting member 4 elastically presses a base end portion of the spark plug 100 toward the tip end side. Thereby, the conducting member 4 and the spark plug 100 are electrically connected.

Next, functions and effects of the present embodiment will be described.

In the ignition coil 1 for the internal combustion engine, the convex surface forming portion 311 has the outer peripheral concave surface 32, the outer peripheral surface of which is recessed toward the inner peripheral side.

Therefore, the connecting portion 3 is able to obtain sufficient flexibility in the outer peripheral concave surface 32 of the convex surface forming portion 311 of which the outer diameter is reduced.

Furthermore, in the convex surface forming portion 311, at least a part of a region where the outer peripheral concave surface 32 is formed has a portion having an area, in a cross-section orthogonal to the axial direction Z, equal to or smaller than an area of a cross-section orthogonal to the axial direction Z in the boundary portion 312.

This also obtains sufficient flexibility in the outer peripheral concave surface 32 of the convex surface forming portion 311 in the connecting portion 3.

Here, since the convex surface forming portion 311 is easily bent as described above, a high withstand voltage is required in consideration of thinning due to bending as compared with other portions.

Therefore, the thickness of the convex surface forming portion 311 is set to be equal to or thicker than the thickness of the boundary portion 312 in the ignition coil 1.

Therefore, it is possible to obtain the withstand voltage of all of the connecting portion 3 by setting the thickness of the convex surface forming portion 311 to such a thickness that a suitable withstand voltage can be obtained.

Further, it is possible to suppress the thickness of a portion other than the convex surface forming portion 311 in the connecting portion 3, which do not require a higher withstand voltage than the convex surface forming portion 311 from increasing.

Thereby, it is possible to reduce the material cost of the connecting portion 3 and to downsize the connecting portion 3.

Further, the conducting member 4 is fitted into the inner peripheral convex surface 33 of the convex surface forming portion 311 of the connecting portion 3.

As described above, even if the diameter of the conducting member 4 is constant in the axial direction Z, for example, the conducting member 4 can be fitted into the inner peripheral convex surface 33 by fitting the conducting member 4 into the inner peripheral convex surface 33 having the larger inner diameter in the convex surface forming portion 311.

Therefore, it is easy to fit the conducting member 4 into the connecting portion 3.

Further, the minimum inner diameter portion 331 of the inner peripheral convex surface 33 and the minimum outer diameter portion 323 of the outer peripheral concave surface 32 are disposed at the same position in the axial direction Z.

Therefore, sufficient flexibility can be obtained in the connecting portion 3 at a portion where the minimum inner diameter portion 331 and the minimum outer diameter portion 323 are formed in the axial direction Z.

Furthermore, the convex surface forming portion 311 has a larger thickness and a smaller cross-sectional area from both ends thereof in the axial direction Z as it approaches toward the center in the present embodiment.

Therefore, while obtaining the withstand voltage of the connecting portion 3, it is possible to obtain sufficient flexibility in the convex surface forming portion 311.

As described above, according to the present embodiment, it is possible to provide an ignition coil for an internal combustion engine capable of achieving cost reduction and downsizing while obtaining insulation.

[Second Embodiment]

Figure 7:
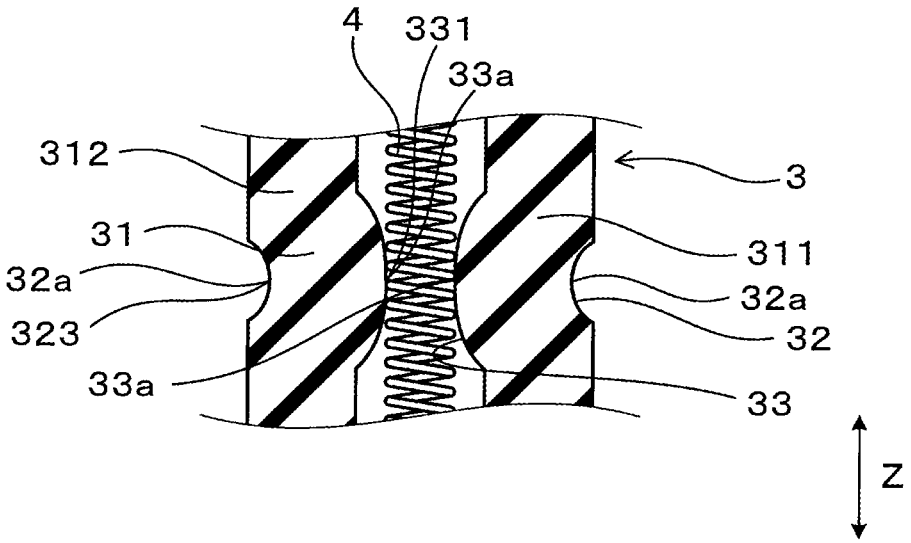
FIG. 7 shows an enlarged axial-sectional view in a periphery of a convex surface forming portion in a second embodiment.
Figure 8:
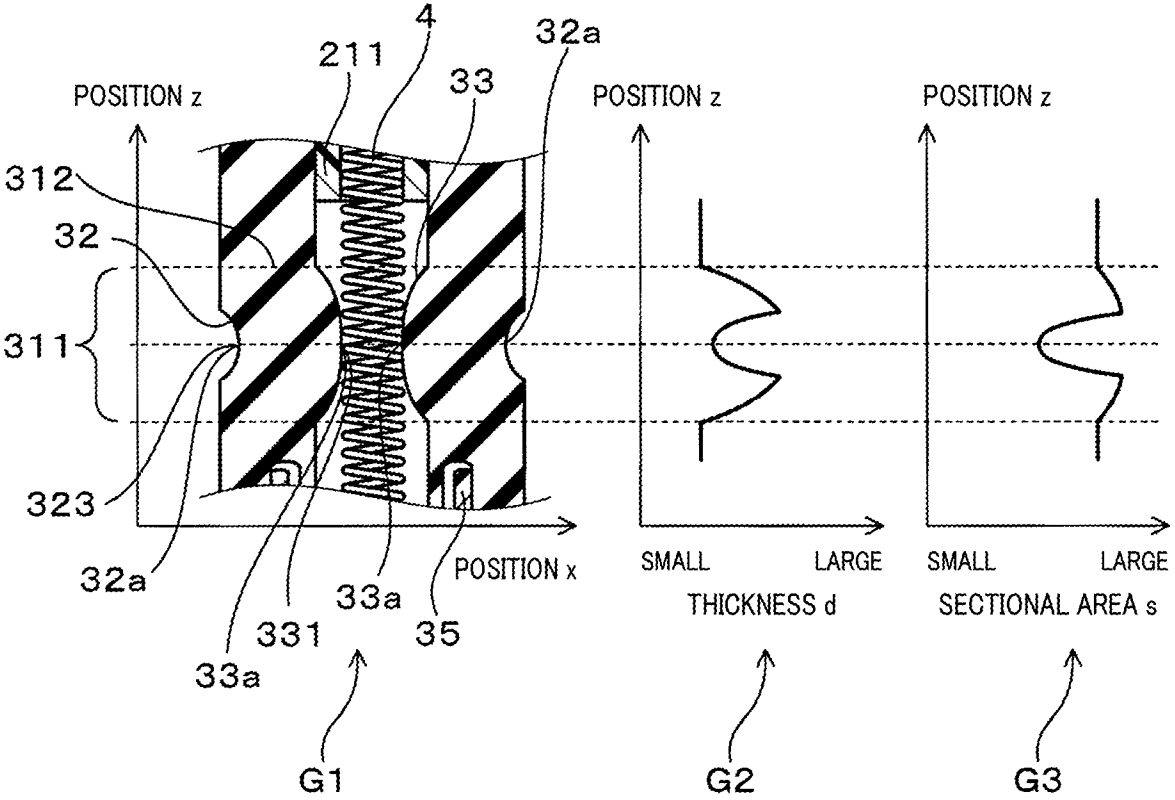
FIG. 8 shows graphs for explaining thickness and cross-sectional area of a bendable portion in the second embodiment.

The present embodiment is an embodiment in which a shape of a convex surface forming portion 311 is changed as compared with the first embodiment as shown in FIGS. 7 and 8.

As shown in FIG. 7, an inner peripheral convex surface 33 is formed in an arc shape convexed toward an inner circumferential side in a cross-section parallel to an axial direction Z passing through a central axis of a connecting portion 3.

Similarly, an outer peripheral concave surface 32 is formed in an arc shape convexed toward the inner circumferential side in a radial direction in the cross-section parallel to the axial direction Z passing through the central axis of the connecting portion 3.

The outer peripheral concave surface 32 is formed in at least a part of a region where the inner peripheral convex surface 33 is formed in the axial direction Z.

Specifically, the outer peripheral concave surface 32 is formed in a center region of the region where the inner peripheral convex surface 33 is formed.

FIG. 8 shows first to third graphs G1, G2, and G3 arranged side by side. The first to third graphs G1, G2, and G3 are similar to those described in the first embodiment.

Also in the present embodiment, a comparison of the thickness d and a comparison of the cross-sectional area s are performed between a boundary portion 312 and the convex surface forming portion 311 from the second graph G2 and the third graph G3.

Also in the present embodiment, the boundary portion 312 of the connecting portion 3 is a portion where both end portions of the inner peripheral convex surface 33 in the axial direction Z are located.

As can be seen from the second graph G2, the convex surface forming portion 311 gradually increases in thickness from both ends toward the center in the axial direction Z, and gradually decreases in thickness thereafter.

However, also in the present embodiment, the thickness of the convex surface forming portion 311 is equal to or thicker than the thickness of the boundary portion 312 in the entire axial direction Z.

As can be seen from the third graph G3, the convex surface forming portion 311 has a portion having a cross-sectional area equal to or smaller than the cross-sectional area of the boundary portion 312 in a part of the region where the outer peripheral concave surface 32 is formed in the axial direction Z.

A cross-sectional area of the convex surface forming portion 311 increases from both ends in the axial direction Z toward the outer peripheral concave surface 32.

However, in a region where the outer peripheral concave surface 32 in the axial direction Z in the convex surface forming portion 311 is formed, the cross-sectional area decreases from both ends in the axial direction Z toward the center.

Then, in a central portion of a region where the outer peripheral concave surface 32 in the axial direction Z in the convex surface forming portion 311 is formed, the cross-sectional area is equal to or smaller than the cross-sectional area of the boundary portion 312.

In the convex surface forming portion 311, a portion where a minimum inner diameter portion 331 of the inner peripheral convex surface 33 and a minimum outer diameter portion 323 of the outer peripheral concave surface 32 in the axial direction Z are formed has the smallest cross-sectional area.

Other configurations are the same as those in the first embodiment.

It should be appreciated that, in the second embodiment and the subsequent embodiments, components identical with or similar to those in the first embodiment are given the same reference numerals, unless otherwise indicated, and repeated structures and features thereof will not be described in order to avoid redundant explanation.

The present embodiment also has the same functions and effects as those of the first embodiment.

[Third Embodiment]

Figure 9:
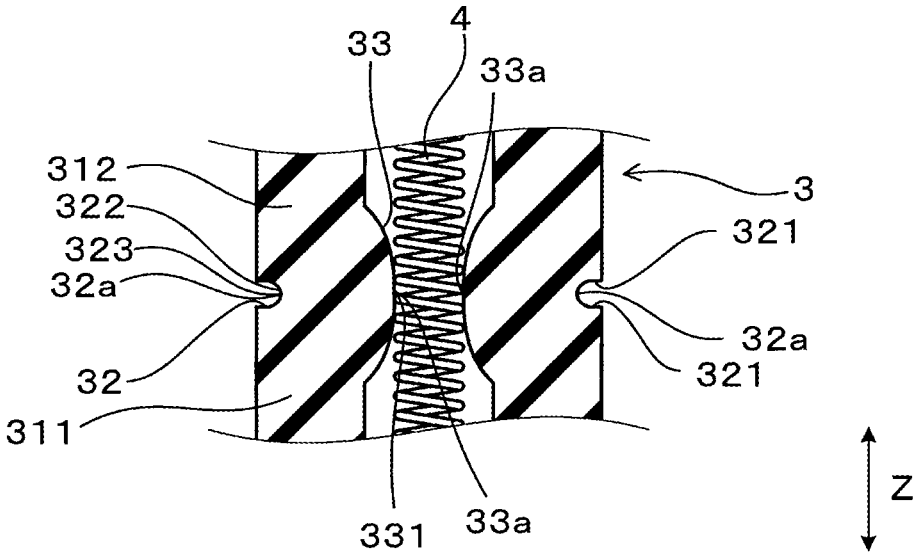
FIG. 9 shows an enlarged axial-sectional view in a periphery of a convex surface forming portion in a third embodiment.

The present embodiment is an embodiment in which a shape of an outer peripheral concave surface 32 is changed as compared with the second embodiment as shown in FIG. 9.

In the present embodiment, the outer peripheral concave surface 32 is formed in a U-shape protruding inward in a radial direction in a cross-section parallel to an axial direction Z passing through a central axis of a connecting portion 3.

That is, the outer peripheral concave surface 32 is formed of a pair of linear portions 321 formed linearly along the radial direction in the cross-section, and an arcuate portion 322 that has an arc shape in the inner circumferential side and that connects inner peripheral ends of the pair of linear portions 321 to each other.

Also in the present embodiment, a boundary portion 312 of the connecting portion 3 is a portion where both end portions of the inner peripheral convex surface 33 in the axial direction Z are located.

Other configurations are the same as those in the second embodiment. The present embodiment also has the same functions and effects as those of the second embodiment.

[Fourth Embodiment]

Figure 10:
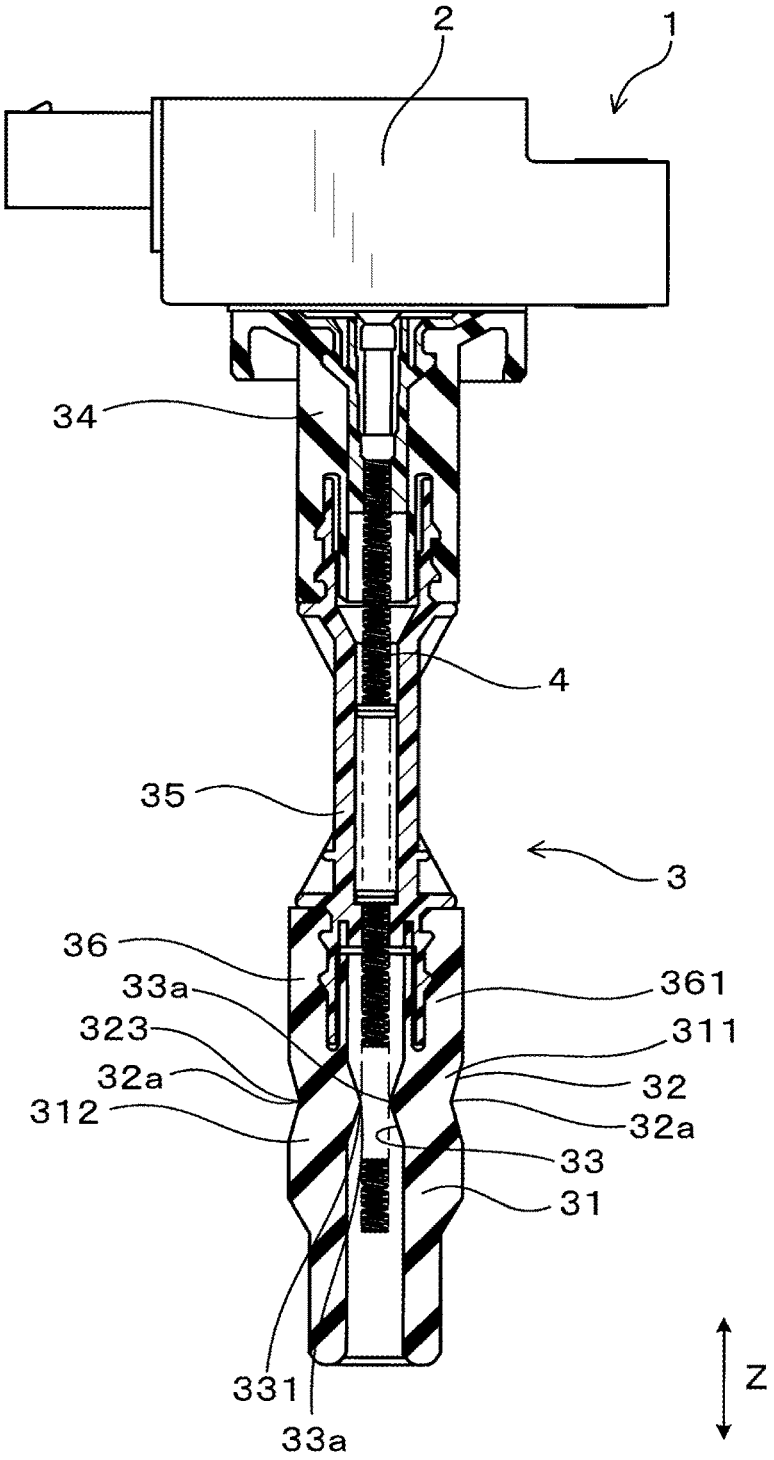
FIG. 10 shows a partial axial-sectional view of an ignition coil for an internal combustion engine in a fourth embodiment.

The present embodiment is an embodiment in which a position of a convex surface forming portion 311 is changed from the first embodiment as shown in FIG. 10.

That is, the convex surface forming portion 311 is formed in a plug cap 36 in the present embodiment.

The plug cap 36 has a cap base end portion 361 which is to be fitted to a tip end portion of a pole joint 35, and has a bendable portion 31 on a tip end side thereof.

In the present embodiment, the bendable portion 31 is formed such that the dimension in the axial direction Z is longer than the cap base end portion 361.

Although not shown, a spark plug 100 is fitted into the plug cap 36 from the tip end side of the plug cap 36.

The convex surface forming portion 311 is formed on the base end side of a base end edge of the spark plug 100 in a state in which the spark plug 100 is fitted in the plug cap 36.

Other configurations are the same as those in the first embodiment. The present embodiment also has the same functions and effects as those of the first embodiment.

[Fifth Embodiment]

Figure 11:
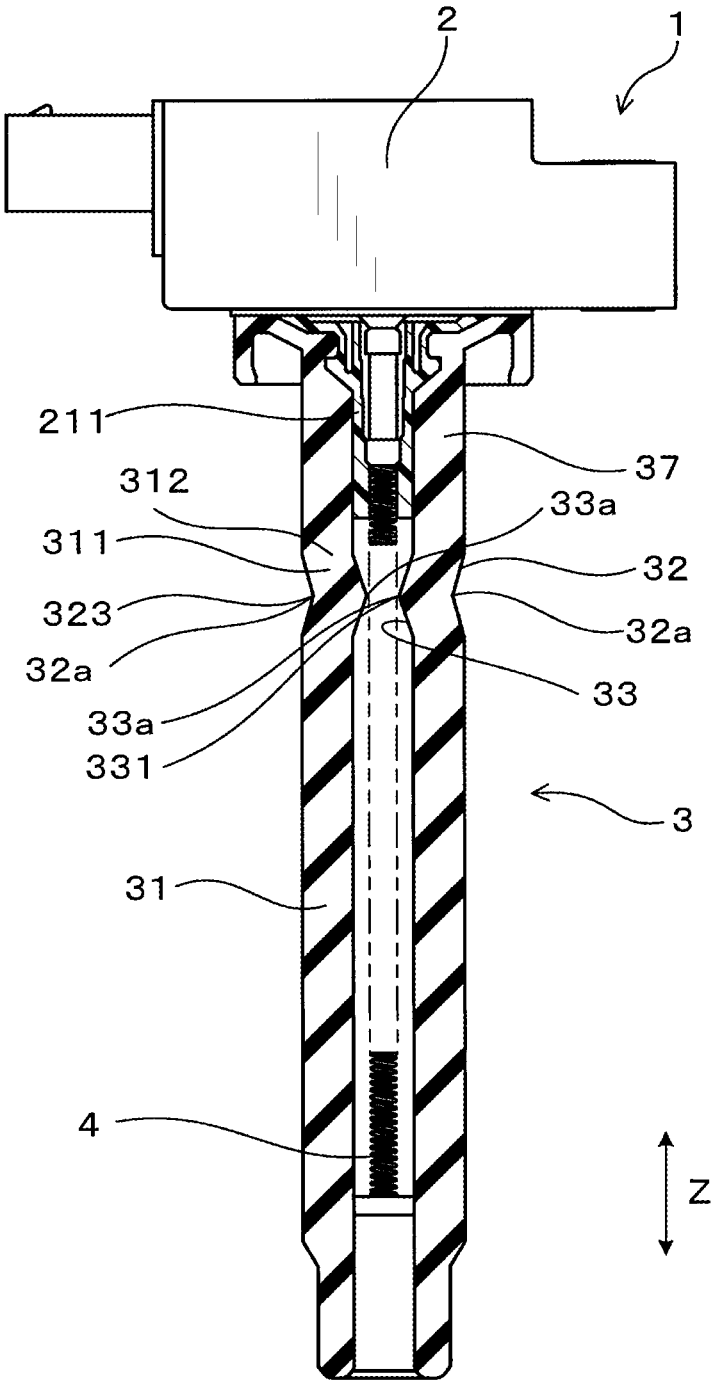
FIG. 11 shows a partial axial-sectional view of an ignition coil for an internal combustion engine in a fifth embodiment.

The present embodiment is an embodiment in which a configuration of a connecting portion 3 is changed from the first embodiment as shown in FIG. 11.

In the present embodiment, all of the connecting portion 3 is integrally formed of the same material. All of the connecting portion 3 is integrally molded with silicone rubber in the present embodiment. However, the material constituting the connecting portion 3 is not limited to silicone rubber.

The connecting portion 3 has a connecting base end portion 37 which is to be fitted to a high-voltage tower portion 211, and has a bendable portion 31 on a distal end side thereof in the present embodiment.

Then, a convex surface forming portion 311 is formed in a part of the bendable portion 31.

Other configurations are the same as those in the first embodiment. The present embodiment also has the same functions and effects as those of the first embodiment.

The present disclosure is not limited to the above-described embodiments, and can be applied to various embodiments without departing from the scope thereof.

Although an example in which the convex surface forming portion of the connecting portion is disposed in the plug hole in the state where the ignition coil is inserted into the plug hole of the engine head is shown in each of the above-described embodiments, for example, the present disclosure is not limited thereto.

That is, in a state where the ignition coil is inserted into the plug hole of the engine head, the connecting portion may have a convex surface forming portion formed outside the plug hole.

In this case, the connecting portion is bent outside the plug hole.

Further, although a state where the minimum inner diameter portion 331 of the inner peripheral convex surface 33 has the first point portion 33*a* and the minimum outer diameter portion 323 of the outer peripheral concave surface 32 has the second point portion 32*a* in the embodiments described above, it is not limited thereto.

Figure 12:
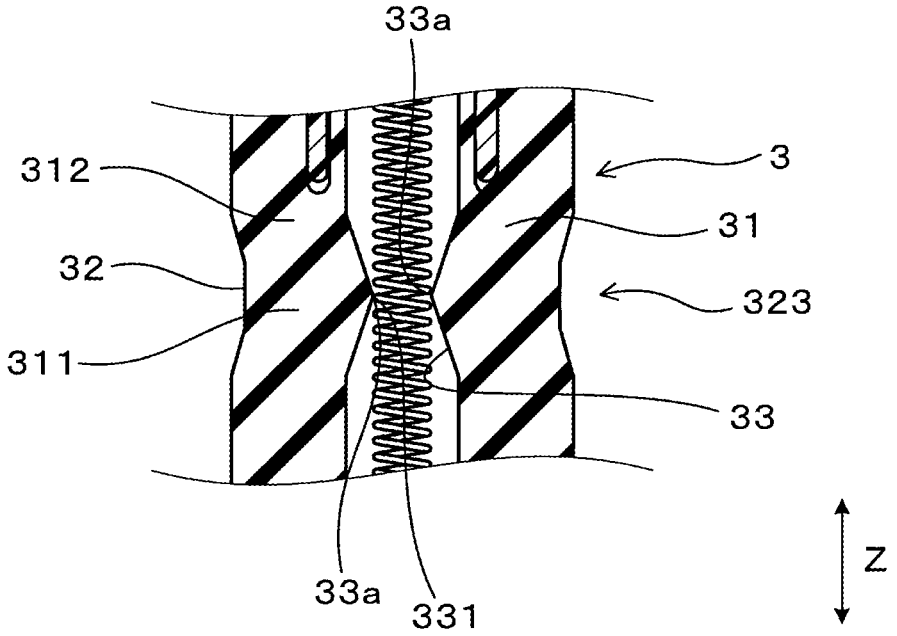
FIG. 12 shows an enlarged axial-sectional view in a periphery of a convex surface forming portion in a first modification.

As shown in FIG. 12, for example, a minimum outer diameter portion 323 of an outer peripheral concave surface 32 may have a constant length in an axial direction Z.

In this case, a second point portion is not formed in the minimum outer diameter portion 323.

Figure 13:
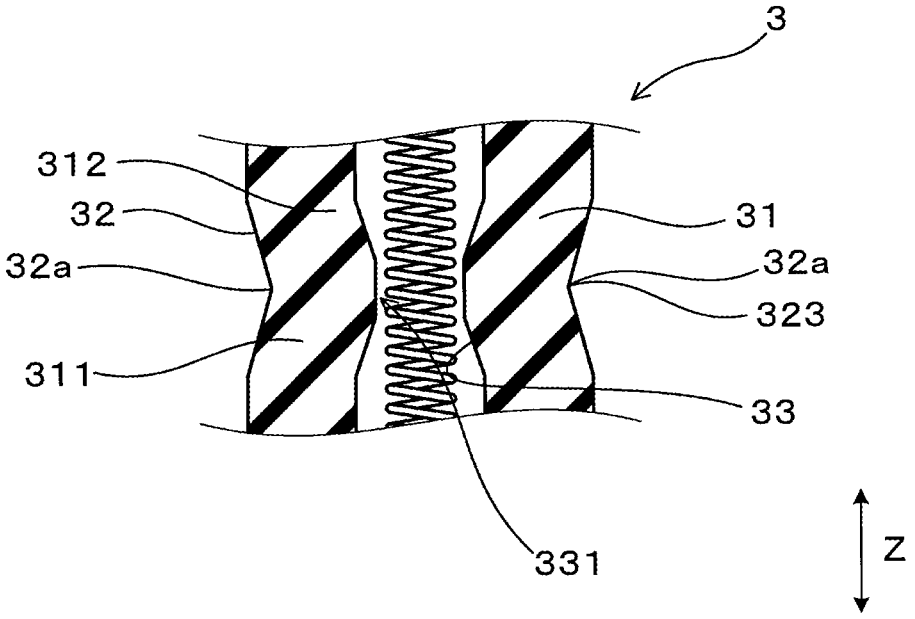
FIG. 13 shows an enlarged axial-sectional view in a periphery of a convex surface forming portion in a second modification t.

Further, as shown in FIG. 13, a minimum inner diameter portion 331 of an inner peripheral convex surface 33 may have a constant length in an axial direction Z.

In this case, a first point portion is not formed in the minimum inner diameter portion 331.

Figure 14:
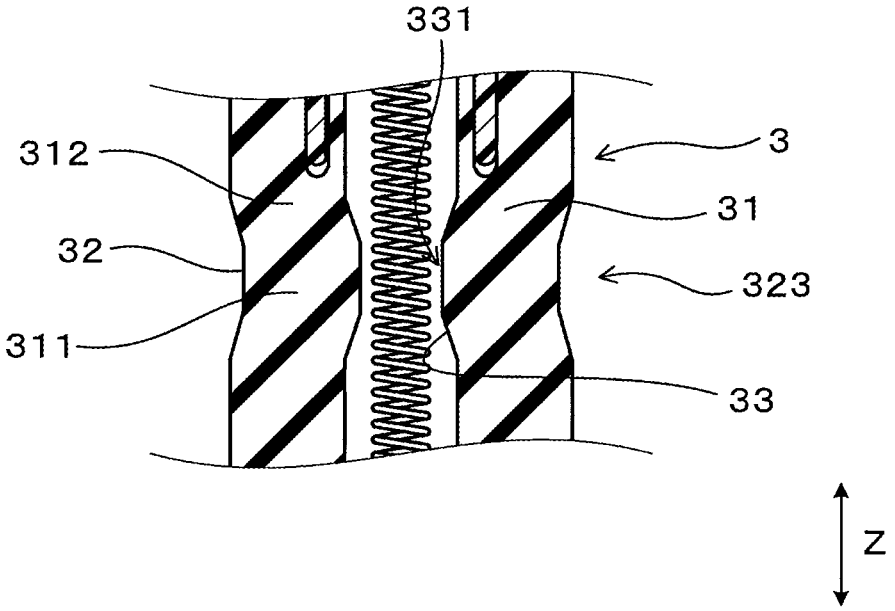
FIG. 14 shows an enlarged axial-sectional view in a periphery of a convex surface forming portion in a third modified embodiment.

Furthermore, as shown in FIG. 14, both a minimum inner diameter portion 331 of an inner peripheral convex surface 33 and a minimum outer diameter portion 323 of an outer peripheral concave surface 32 may have constant lengths in an axial direction Z.

In this case, none of a first point portion and a second point portion is formed in a convex surface forming portion 311.

As described above, it is also possible to adopt an aspect in which at least one of the first point portion and the second point portion is not formed.

What is claimed is:

1. An ignition coil for an internal combustion engine comprising:

a coil main body portion having a primary coil and a secondary coil magnetically coupled to each other;

a cylindrical connecting portion for connecting the coil main body portion and a spark plug; and a conducting member disposed inside the connecting portion and electrically connecting the coil main body portion and the spark plug; wherein a convex surface forming portion, which is a portion constituting an inner peripheral convex surface, an inner peripheral surface of which projects toward an inner peripheral side, is disposed in the connecting portion;

the convex surface forming portion has an outer peripheral concave surface, an outer peripheral surface of which is recessed toward the inner peripheral side;

the connecting portion has a boundary portion which is a boundary between the convex surface forming portion and other portions in an axial direction;

in the convex surface forming portion, at least a part of a region where the outer peripheral concave surface is formed has a portion having an area, in a cross-section orthogonal to the axial direction, equal to or smaller than an area of a cross-section orthogonal to the axial direction in the boundary portion, and a thickness of the convex surface forming portion is equal to or thicker than a thickness of the boundary portion; and a thickness of the convex surface forming portion is equal to or thicker than a thickness of the boundary portion.

2. The ignition coil for the internal combustion engine according to claim 1, wherein the conducting member is fitted in the inner peripheral convex surface of the convex surface forming portion of the connecting portion.

3. The ignition coil for the internal combustion engine according to claim 1, wherein the connecting portion includes:

a seal having elasticity for sealing between an engine head through which the ignition coil is inserted and the coil main body portion;

a resin-made pole joint fitted to the seal on an end where the spark plug is disposed; and a plug cap fitted to the pole joint on the end where the spark plug is disposed and fitting the spark plug; wherein the convex surface forming portion is formed in the seal.

4. The ignition coil for the internal combustion engine according to claim 2, wherein the connecting portion includes:

a seal having elasticity for sealing between an engine head through which the ignition coil is inserted and the coil main body portion;

a resin-made pole joint fitted to the seal on an end where the spark plug is disposed; and a plug cap fitted to the pole joint on the end where the spark plug is disposed and fitting the spark plug; wherein the convex surface forming portion is formed in the seal.

5. The ignition coil for the internal combustion engine according to claim 1, wherein the connecting portion includes:

a seal having elasticity for sealing between an engine head through which the ignition coil is inserted and the coil main body portion;

a resin-made pole joint fitted to the seal on an end where the spark plug is disposed; and a plug cap fitted to the pole joint on the end where the spark plug is disposed and fitting the spark plug; wherein the convex surface forming portion is formed in the plug cap.

6. The ignition coil for the internal combustion engine according to claim 2, wherein the connecting portion includes:

a seal having elasticity for sealing between an engine head through which the ignition coil is inserted and the coil main body portion;

a resin-made pole joint fitted to the seal on an end where the spark plug is disposed; and a plug cap fitted to the pole joint on the end where the spark plug is disposed and fitting the spark plug; wherein the convex surface forming portion is formed in the plug cap.

7. The ignition coil for the internal combustion engine according to claim 1, wherein all of the connecting portion is integrally formed of the same material.

8. The ignition coil for the internal combustion engine according to claim 2, wherein all of the connecting portion is integrally formed of the same material.

9. The ignition coil for the internal combustion engine according to claim 1, wherein when a portion having the smallest inner diameter in the inner peripheral convex surface is defined as a minimum inner diameter portion and a portion having the smallest outer diameter in the outer peripheral concave surface is defined as a minimum outer diameter portion, the minimum inner diameter portion and the minimum outer diameter portion are disposed at the same position in the axial direction.

* * * * *